US006309176B1

(12) United States Patent
Periyathamby et al.

(10) Patent No.: US 6,309,176 B1
(45) Date of Patent: Oct. 30, 2001

(54) NOISE ATTENUATING SOUND RESONATOR FOR AUTOMOTIVE COOLING MODULE SHROUD

(75) Inventors: Haran K. Periyathamby, Toronto; Marek Horski, London, both of (CA)

(73) Assignee: Siemens Automotive Inc., Mississauga (CA)

( * ) Notice: Subject to any disclaimer, the term of this patent is extended or adjusted under 35 U.S.C. 154(b) by 0 days.

(21) Appl. No.: 09/439,653

(22) Filed: Nov. 12, 1999

(51) Int. Cl.[7] ..... F01D 5/10; F01D 5/16

(52) U.S. Cl. ..... 415/119; 415/170.1; 415/173.6; 415/213.1

(58) Field of Search ..... 415/119, 170.1, 415/173.6, 174.5, 222, 223, 213.1; 123/41.49; 181/224, 225

(56) References Cited

U.S. PATENT DOCUMENTS

| | | | | |
|---|---|---|---|---|
| 3,819,008 | | 6/1974 | Evans et al. | 181/33 D |
| 3,850,261 | | 11/1974 | Hehmann et al. | 181/33 G |
| 4,018,297 | * | 4/1977 | Haupt | 415/213.1 |
| 4,231,447 | | 11/1980 | Chapman | 181/213 |
| 4,260,037 | | 4/1981 | Eline | 181/204 |
| 4,330,047 | | 5/1982 | Ruspa et al. | 181/224 |
| 4,433,751 | | 2/1984 | Bonneau | 181/213 |
| 4,475,867 | | 10/1984 | Smith | 415/119 |
| 4,503,931 | | 3/1985 | Sugimoto et al. | 181/204 |
| 4,596,921 | | 6/1986 | Hersh et al. | 219/370 |
| 4,750,860 | | 6/1988 | Kelley | 415/119 |
| 4,836,148 | | 6/1989 | Savage et al. | 123/41.49 |
| 4,858,721 | * | 8/1989 | Autie et al. | 181/224 |
| 5,096,013 | * | 3/1992 | Yoshida et al. | 415/119 |
| 5,183,382 | | 2/1993 | Carroll | 415/173.6 |
| 5,590,849 | | 1/1997 | Pla | 244/1 N |
| 5,625,172 | | 4/1997 | Blichmann et al. | 181/204 |

FOREIGN PATENT DOCUMENTS

| | | | |
|---|---|---|---|
| 62-217833 | * | 9/1987 | (JP) . |
| 05-228013 | * | 9/1993 | (JP) . |
| 10-306972 | * | 11/1998 | (JP) . |

* cited by examiner

*Primary Examiner*—Edward K. Look
*Assistant Examiner*—Richard Woo

(57) ABSTRACT

A cooling structure 10 for cooling an engine includes an axial flow fan 16 having a plurality of blades 14. A shroud 12 is spaced from and is generally adjacent to the blades 14. A plurality of Helmholtz resonators 24 and 24' is carried by the shroud 12. Each of the resonators 24 and 24' has an opening disposed substantially perpendicular with respect to a direction of air flow resulting from rotation of the fan 16. The resonators 24 and 24' are disposed at locations on the shroud 12 which are generally adjacent to tips 32 of the blades 14. The resonators 24 and 24' are tuned to reduce blade passing tone of the fan 14.

18 Claims, 4 Drawing Sheets

NOISE ATTENUATING SOUND RESONATOR FOR AUTOMOTIVE COOLING MODULE SHROUD

FIELD OF THE INVENTION

This invention relates to cooling systems of an internal combustion engine and more particularly to sound absorption resonators incorporated into a fan shroud of the cooing system.

BACKGROUND OF THE INVENTION

Noise, particularly blade passing tone, produced by an axial flow fan of an engine cooling system has been a concern in the automotive industry. The term "axial flow fan" used herein refers to any fan of the general type in which the flow of air or other gas is in a direction parallel to the axis about which the fan blades rotate.

A technique for reducing noise in axial flow fans includes employing noise absorption material in regions near the fan or otherwise adjacent to the fluid flow. This technique is helpful but the effectiveness is limited in certain frequency ranges such as absorbing the passing blade tonal frequency.

Accordingly, there is a need to provide a cooling structure including at least one resonator thereon so as to reduce or eliminate blade passing tonal noise.

SUMMARY OF THE INVENTION

An object of the present invention is to fulfill the need referred to above. In accordance with the principles of the present invention, this objective is obtained by providing a cooling structure for cooling an engine. The cooling structure includes an axial flow fan having a plurality of blades. A shroud is spaced from and is generally adjacent to the blades. A plurality of Helmholtz resonators is carried by the shroud. Each of the resonators has an opening disposed substantially perpendicular with respect to a direction of air flow resulting from rotation of the fan. The resonators are disposed at locations on the shroud which are generally adjacent to tips of the blades. The resonators are tuned to reduce the blade passing tone of the fan.

In accordance with another aspect of the invention, a method of absorbing the blade passing tone noise produced from an axial flow fan for cooling an engine includes providing a shroud spaced from and generally adjacent to blades of the fan. A plurality of Helmholtz resonators are provided and carried by the shroud. Each of the resonators has an opening disposed substantially perpendicular with respect to a direction of air flow resulting from rotation of the fan. The resonators are disposed at locations on the shroud which are generally adjacent to tips of the blades. The resonators are tuned to reduce the blade passing tone of the fan.

Other objects, features and characteristics of the present invention, as well as the methods of operation and the functions of the related elements of the structure, the combination of parts and economics of manufacture will become more apparent upon consideration of the following detailed description and appended claims with reference to the accompanying drawings, all of which form a part of this specification.

DETAILED DESCRIPTION OF THE INVENTION

Figure 1:
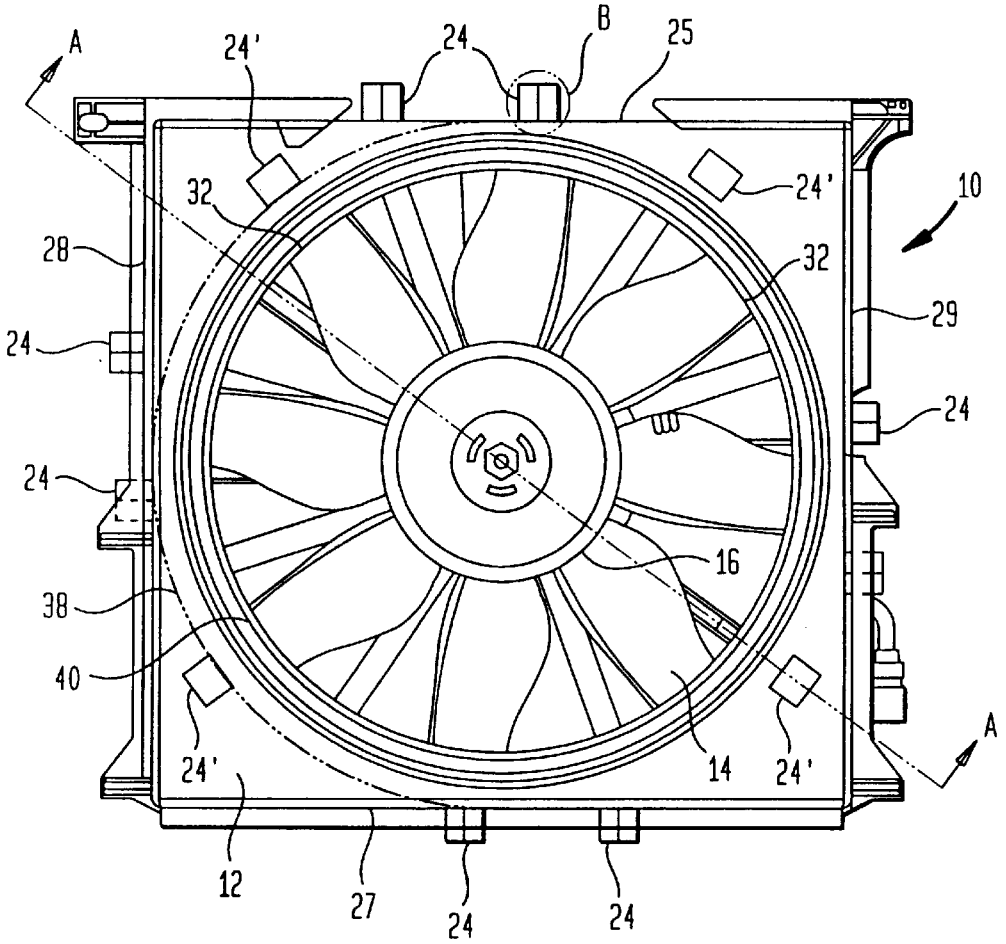
FIG. 1 is front view of a cooling structure provided in accordance with the principles of the present invention.

Referring to FIG. 1, a cooling structure for cooling a vehicle engine is shown, generally indicated 10, provided in accordance with the principles of the present invention. The cooling structure 10 includes a shroud 12, formed preferably of lightweight material such as plastic. In the conventional manner, the shroud structure 12 is spaced from and generally adjacent to blades 14 of a fan 16 of the cooling structure 10 to guide the air flow and to prevent foreign objects from contacting the rotating blades. The shroud 12 is constructed and arranged to be coupled to a radiator (not shown) of an engine cooling system.

Figure 2:
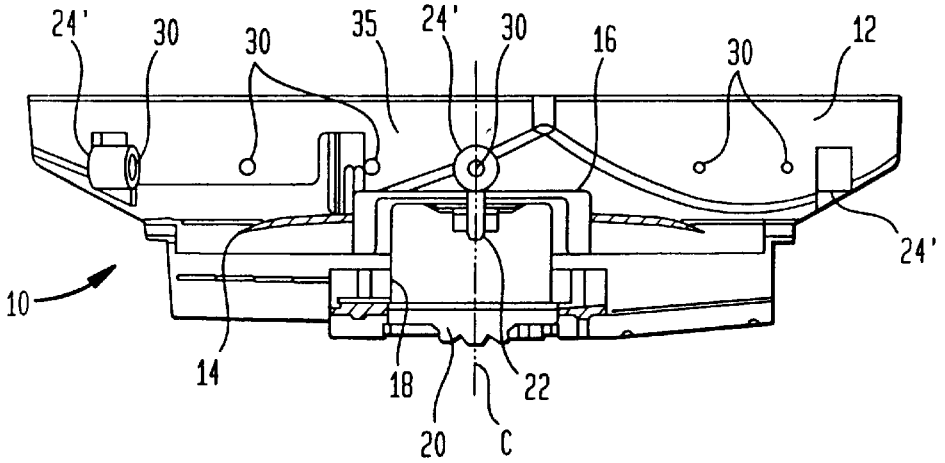
FIG. 2 is a view of the cooling structure taken along the line A—A of FIG. 1.

With reference to FIG. 2, the cooling structure 10 includes a dc electric motor 20 coupled to the fan 16 via shaft 22 so as to cause rotation of the fan 16.

Figure 3:
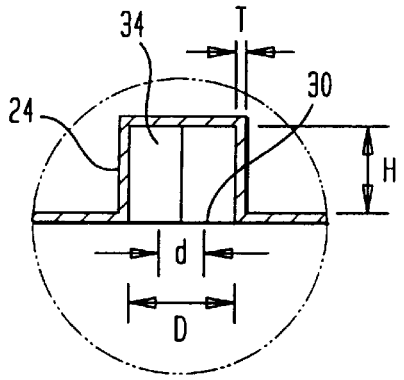
FIG. 3 is an enlarged view of the portion B encircled in FIG. 1.
Figure 4:
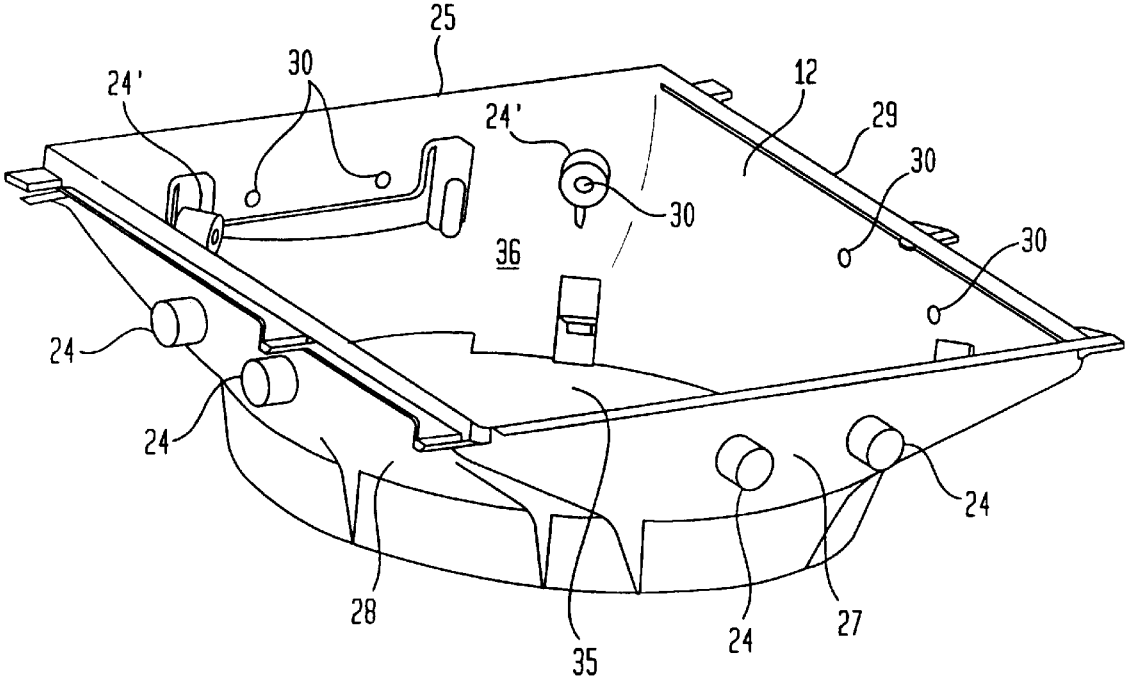
FIG. 4 is a perspective view of a shroud of the cooling structure of FIG. 1.
Figure 5:
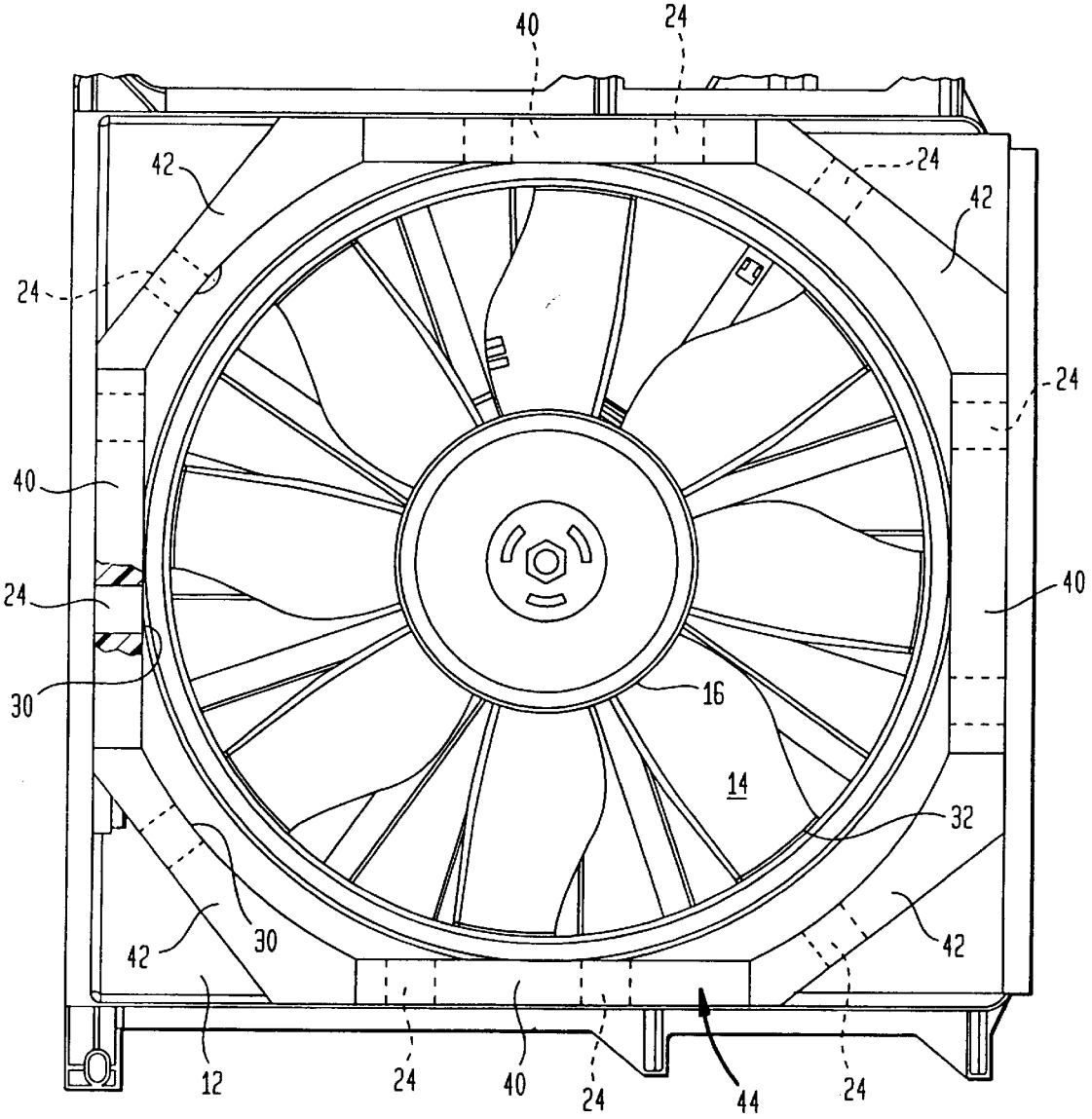
FIG. 5 is a front view of a second embodiment of the cooling structure of the invention.

In accordance with the principles of the present invention, a plurality of Helmholtz resonators 24 are carried by the shroud 12. As shown in FIGS. 1 and 4 the shroud 12 is generally square in shape having four sides 25, 27, 28 and 29. In the embodiment, two resonators 24 are disposed on each side 25, 27, 28 and 29 of the shroud 12 such that the opening 30 (FIG. 3) is directed towards tips 32 of the blades 14. With reference to FIG. 3, each resonator 24 is generally of cylindrical, having an orifice opening 30 which communicates with an internal cavity 34. Each resonator 24 extends outwardly from a respective side of the shroud 12 with opening 30 defined in internal wall 36 of the shroud 12.

In addition, certain of the resonators 24' are disposed in an interior chamber 35 defined by the internal wall 36 of the shroud 12. Openings 30 of the resonators 24 and 24' are in open communication with the internal chamber 35. As best shown in FIG. 1, resonators 24' are disposed on a first circle 38 which is concentric with a circle 40 defined by the blade tips 32. As shown, the first circle 38 has a radius greater than a radius of the second circle 40.

Each of the resonators 24 and 24' has its opening 30 disposed substantially perpendicular with respect to a direction of air flow which results from rotation of the fan 16. With reference to FIG. 2, air flow is directed along axis C. The resonators 24 and 24' are disposed at locations on the shroud 12 beyond the extent of the blade tips 32 and generally adjacent thereto.

As noted above, the resonators 24 and 24' of the invention are Helmholtz resonators which are acoustic oscillators having a resonant frequency tuned to the fan blade passing tone. The geometry of each resonator is determined by the size of the cavity 34 of the resonator and the size of the orifice or opening 30 through which air may enter and escape from the cavity 34. In the illustrated embodiment and with reference to FIG. 3, each resonator 24 and 24' is of generally cylindrical shape. The specific resonator dimensions are chosen for the particular cooling structure so as to be tuned to the fan blade passing tone.

The Helmholtz resonator may be compared to a typical mechanical spring mass system. The equivalent of the spring is the compressibility of the gas in the cavity 34 and the equivalent of the mass of the spring-mass system is the effective mass of the air in the orifice 30. If the resonator is tuned to the fan blade passing rate, then any pressure disturbances at the blade passing rate will cause the resonator to oscillate, thereby acting as a large air source and sink at that frequency to effectively absorb the pressure disturbances rather than permitting the pressure disturbance from passing outwardly of the shroud 12.

For a spring mass system where M is mass and K is the spring constant, the natural frequency f of the system is:

$$f_{nat} = \frac{1}{2\pi}\sqrt{\frac{k}{m}}$$

Figure 7:
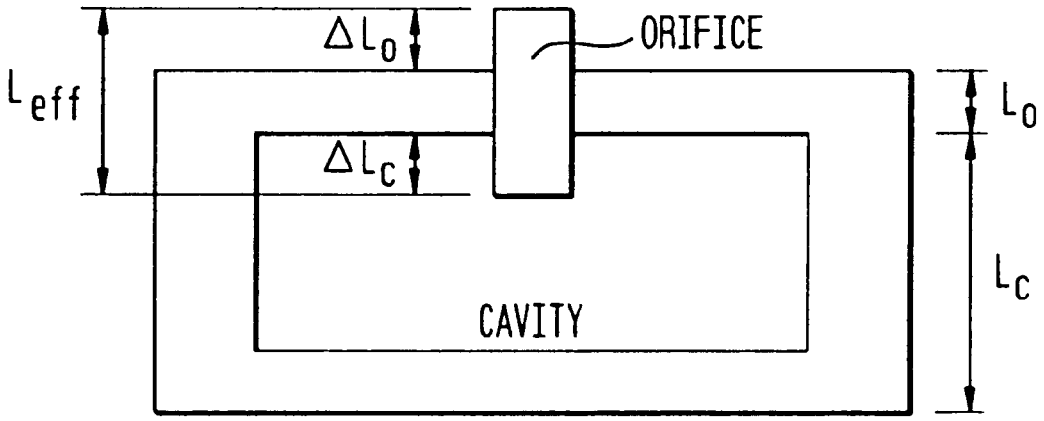
FIG. 7 is a schematic view of a Helmholtz resonator showing certain lengths for calculating effective length.

With reference to FIG. 7 for a Helmholtz resonator wherein $A_O$ is the orifice cross-sectional area, $A_c$ is the cavity cross-sectional area, L is the length from the opening to the cavity and $V_c$ is the volume of the cavity, then $$M=\rho A L_{eff}$$

$$L_{eff}=L+0.8\sqrt{A_O}$$

where $L_{eff}$ is effective length,

As shown in FIG. 7, $L_{eff}=\Delta L_O+\Delta L_c+L_O$ $$k = \frac{BA_o^2}{V_c}$$

where B is the Bulk modulus, $$f_{nat} = \frac{C_o}{2\pi}\sqrt{\frac{A_o}{L_{eff}V_c}}$$

$$Z_{helm} = \frac{P_{helm}}{Vel} = \left|\frac{\gamma M\omega - \gamma k/\omega}{A_o}\right.$$

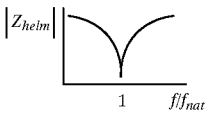

where $Z_{helm}$ if acoustic impedance of a Helmholtz resonator.

Figure 6:
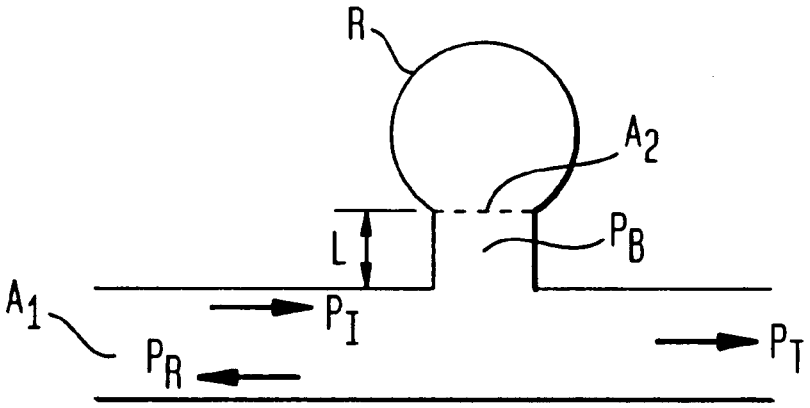
FIG. 6 is a schematic view of a resonator in a flow path showing various pressures and areas.

Modeling for sound transmission loss from a Helmholtz resonator R will be explained with reference to FIG. 6. The following equations are applicable:

$$P_I=\rho c V_I$$

$$P_R=-\rho c V_R$$

$$P_T=\rho c V_T$$

At the resonator:

$$P_I+P_R=P_T=P_B$$

$$A_1(V_1+V_R)=A_1V_R+A_2V_B$$

Accordingly, $$P_T = \frac{P_I}{1+\frac{\rho c A_2}{2Z_{helm}A_1}}$$

Note that when $Z_{helm}=0$ $$\tau(\text{transmission loss}) = 10\log_{10}\left[\frac{P_I}{P_T}\right]^2$$

$$\tau = 20\log\left(1+\frac{\rho c A_2}{2A_2R}\right)$$

Where $R_a$=acoustic resistance:

$$R_a = \frac{\rho c A_o^{5/2}}{2\pi V_c} = Z_{helm}$$

for absorption at $f=f_n$.

The dimension of the resonator is selected to meet $f/f_n=1$.

Returning to the description of the invention, the shroud 12 is preferably molded from plastic. In the embodiment of FIGS. 1–5, the resonators 24 and 24' are unitary members formed preferably from plastic and mounted by clips, adhesive or any conventional manner to the shroud 12. Alternatively, the resonators may be molded integrally with the shroud. FIG. 6 shows a second embodiment of the invention wherein the shroud includes a plurality of segments with each segment disposed beyond an extent of tips 32 of the blades 14. Each segment carries at least one resonator 24 such that the opening 30 of the resonator 24 generally faces the tips 32 of the blades 14. The segments include linear segments 40 disposed between generally radial segments 42 and all segments are joined to define a continuous resonator carrying structure, generally indicated at 44. Each segment 40 and 42 is molded from plastic with the resonator(s) being coupled thereto or molded integrally therewith. The segments 40 and 42 are secured to the shroud 12 and add rigidity to the shroud. In the embodiment, each linear segment 40 carries two resonators 24 and each radial segment 42 carries one resonator 24.

In the embodiment, all resonators are configured generally identically so as to absorb the blade passing tone within a certain range of frequencies. If noise is generated at other frequency ranges, one or more additional set(s) of resonators, configured to absorb these frequencies can be provided on the shroud.

Although a certain number of resonators were shown at certain locations on the shroud, the locations and number of resonators on the shroud may vary due to the particular shroud and fan configuration.

The foregoing preferred embodiments have been shown and described for the purposes of illustrating the structural and functional principles of the present invention, as well as illustrating the methods of employing the preferred embodiments and are subject to change without departing from such principles. Therefore, this invention includes all modifications encompassed within the spirit of the following claims.

What is claimed is:

1. A cooling structure for cooling an engine comprising:

an axial flow fan having a plurality of blades;

a shroud spaced from and generally adjacent to said blades; and a plurality of Helmholtz resonators carried by said shroud, each of said resonators having an opening disposed substantially perpendicular with respect to a direction of air flow resulting from rotation of said fan, said resonators being disposed at locations on said shroud which are generally adjacent to tips of said blades, and said resonators being tuned to reduce blade passing tone of the fan, wherein a number of said plurality of resonators are disposed on a first circle concentric with a second circle defined by said blade tips, said first circle having a radius greater than a radius of said second circle, and wherein said shroud has four sides and a number of said resonators are disposed on each said side and each said resonator extends outwardly from an associated side.

2. The cooling structure according to claim 1, wherein two said resonators are disposed on each said side.

3. The cooling structure according to claim 1, wherein each said resonator is a unitary member mounted to said shroud.

4. The cooling structure according to claim 1, wherein said shroud has internal walls defining an interior chamber of said shroud, each of openings of said resonators being in open communication with said interior chamber.

5. The cooling structure according to claim 1, further including a direct current motor coupled to said fan to rotate said fan.

6. The cooling structure according to claim 1, wherein said shroud includes a plurality of segments, each said segment being disposed beyond an extent of tips of said blades and carrying at least one said resonator, each said resonator having said opening generally facing the tips of said blades.

7. The cooling structure according to claim 6, wherein said segments include linear segments disposed between generally radial segments to define a continuous resonator carrying structure.

8. The cooling structure according to claim 7, wherein each said linear segment carries two said resonators and each said radial segment carries one said resonator.

9. The cooling structure according to claim 8, wherein each said resonator is a unitary member coupled to an associated segment.

10. A method of absorbing blade passing tone noise produced from an axial flow fan for cooling an engine, the method comprising:

providing a shroud spaced from and generally adjacent to blades of the fan;

providing a plurality of Helmholtz resonators carried by said shroud, each of said resonators having an opening disposed substantially perpendicular with respect to a direction of air flow resulting from rotation of said fan, said resonators being disposed at locations on said shroud which are generally adjacent to tips of said blades, wherein a number of said plurality of resonators are provided on a first circle concentric with a second circle defined by said blade tips, said first circle having a radius greater than a radius of said second circle, and wherein said shroud has four sides and a number of said resonators are provided on each said side and each said resonator extends outwardly from an associated side; and tuning said resonators to reduce the blade passing tone of the fan.

11. The method according to claim 10, wherein two said resonators are disposed on each said side.

12. The method according to claim 10, wherein each said resonator is a unitary member coupled to said shroud.

13. The method according to claim 10, wherein said shroud has internal walls defining an interior chamber of said shroud, each of openings of said resonators being in open communication with said interior chamber.

14. The method according to claim 10, further including coupling a direct current motor to said fan to rotate said fan.

15. The method according to claim 10, wherein said shroud includes a plurality of segments, each said segment being disposed beyond an extent of tips of said blades and carrying at least one said resonator, each said resonator having said opening generally facing the tips of said blades.

16. The method according to claim 15, wherein said segments include linear segments disposed between generally radial segments to define a continuous resonator carrying structure.

17. The method according to claim 16, wherein each said linear segment carries two said resonators and each said radial segment carries one said resonator.

18. The method according to claim 17, wherein each said resonator is unitary member coupled to an associated segment.

* * * * *